US006997423B1

(12) United States Patent
Nudo, Jr.

(10) Patent No.: US 6,997,423 B1
(45) Date of Patent: Feb. 14, 2006

(54) SIGN POST ASSEMBLY

(76) Inventor: Samuel Nudo, Jr., 4908 Bears Paw, Springfield, IL (US) 62707

( * ) Notice: Subject to any disclaimer, the term of this patent is extended or adjusted under 35 U.S.C. 154(b) by 106 days.

(21) Appl. No.: 10/778,068

(22) Filed: Feb. 17, 2004

(51) Int. Cl.
*A45F 3/44* (2006.01)

(52) U.S. Cl. ..... 248/156; 248/469; 248/473; 248/475.1; 40/606.01; 40/606.14; 40/607.01; 40/607.05

(58) Field of Classification Search ..... 248/156, 248/127, 469, 473, 475.1, 480, 488; 40/606.01, 40/606.14, 607.01, 607.05, 611.06, 611.07, 40/611.09–13
See application file for complete search history.

(56) References Cited

U.S. PATENT DOCUMENTS

| | | | | |
|---|---|---|---|---|
| 1,028,279 | A | 6/1912 | Richardson et al. | |
| 1,148,114 | A | 7/1915 | Morris et al. | |
| 2,872,750 | A * | 2/1959 | Holcomb | 40/610 |
| 3,021,115 | A | 2/1962 | Dake | |
| 3,415,519 | A | 12/1968 | Hand | |
| 3,524,627 | A | 8/1970 | Boyanton et al. | |
| 4,241,530 | A | 12/1980 | Hartvig | |
| 4,658,527 | A | 4/1987 | Pingel | |
| 4,894,937 | A | 1/1990 | Davis | |
| 5,042,183 | A | 8/1991 | Kennedy | |
| 5,066,163 | A | 11/1991 | Whitaker | |
| 5,103,582 | A | 4/1992 | Farmer | |
| 5,307,580 | A | 5/1994 | Farmer | |
| 5,566,483 | A | 10/1996 | Ogren | |
| 5,795,503 | A | 8/1998 | Krake | |
| 5,938,184 | A | 8/1999 | DeSouza | |
| 6,170,183 | B1 | 1/2001 | Keefe | |
| 6,390,436 | B2 * | 5/2002 | Barnes et al. | 248/548 |

* cited by examiner

*Primary Examiner*—Robert P. Olszewski
*Assistant Examiner*—Todd M. Epps

(57) ABSTRACT

A durable sign post assembly is provided with weatherproof sign posts for mounting a laminated sign board. The sign posts are made of a plurality of laminated sheets of a high molecular weight high density polyethylene sheets. An adjustable bracket means is attached inside each sign receiving slot for mounting and supporting the sign between the sign posts.

4 Claims, 2 Drawing Sheets

SIGN POST ASSEMBLY

BACKGROUND OF THE INVENTION

The present invention relates to high polyethylene laminated sign post assembly for mounting a laminated polyethylene sign.

Common methods of mounting signs generally require fasteners and one or more sign posts. Some mounting assemblies, such as those used in the real estate industry require a wooden post with bolts which are used in the field to attach the sign to the post. Theses types of posts have an L-shape with a colorful advertising sign hung by chains attached to the overhead section of the post. The post is supported in the ground by digging a hole in the seller's front yard and planting the post. After use, the post is removed from the ground and returned to the agency or contractor. Wooden sign posts are aesthetically pleasing, but must be painted and protected against deterioration by treatment. Wood is also much more expensive today and the post designs offered in wood are expensive to customize.

Metal sign assemblies are offered for their durability and ruggedness. Most metal sign post assemblies are preassembled so there is no field work. Other types of larger metal sign posts require cumbersome brackets and paint. The metal presentation is undesirable for aesthetic reasons.

Signs generally come in a variety of forms and for different displays (such as speed limit signs) and information signs (e.g., historical markers, and signs indicating direction and distance to a given city or town) represent just a few types of signs. Usually, all of the information on the sign is painted or otherwise printed thereon in large, easily read letters and symbols.

Another common type of informational sign is a "For Sale" sign announcing that a house is for sale. Such a sign, which usually includes the name and telephone number of the realtor, is ordinarily permanently attached to a stake (e.g., a metal pipe or rod) which can be driven into the ground.

Other types of signs require some information to be filled in. Such signs may include announcements of a transitory nature, such as a parking ban of a temporary nature, wherein the sign may include a printed message such as "No Parking From_to_" with the times denoting the start and the end of the parking ban filled in by hand in the blanks.

Portable billboards for announcing special occasions, such as birthdays and anniversaries, have become popular in recent years. Such a sign typically includes an upright easel with a supporting structure for removable letters. Such signs are frequently illuminated. Removable letters are inserted to spell out the desired message, e.g., "Happy Birthday, Pat". Such signs have two objections: they are large (several feet wide and several feet high), ostentatious, and comparatively expensive to rent.

Signs for announcing special occasions are also commercially available. These fall generally into two categories: those in which the sign as sold to the user is affixed to a stake (e.g., by glue or staples), and those in which the sign is supplied without mounting materials (e.g., a stake and some means for securing the sign to the stake).

Plastic support assemblies for signs are commonly used today in the advertising of a business. The support assemblies often include a plastic support piece including fasteners.

Of the plastic sign post assemblies currently on the market, none provide the user with substantial strength and a quick assembly feature for mounting the sign in the field.

There remains a need in the industry to provide a sign post assembly that provides an aesthetically pleasing advertisement which will not deteriorate or fall apart due to inclement weather.

SUMMARY OF THE INVENTION

The present invention is directed to a high density polyethylene laminated sign post assembly for mounting polyethylene sign, said sign post assembly.

It is an object of the present invention to introduce a laminated sign post assembly having two sign posts, each post made of a plurality of laminated sheets of high density polyethylene sheets.

It is a further object of the present invention to provide a high density polyethylene laminated sign post assembly having a pair of sign posts, each sign post having a tapering bottom end for insertion into a supporting surface, an interior side wall, an exterior side wall, a front wall, a rear wall and a top wall, said interior side wall having a sign receiving slot for supporting a sign, and a bracket for connecting a sign to each sign post.

It is still a further object of the present invention to provide a high density polyethylene laminated sign post assembly having a pair of sign posts, each sign post having an L-shaped bracket means for adjustably connecting a sign to each sign post.

The present invention is directed to a durable, weather resistant, sign post assembly formed from high density polyethylene laminated sign posts. Each sign post is made with slots and a tapering bottom end for insertion into a supporting surface. The laminated polyethylene posts provide an unexpected resistance to weather and offer a surface which is unaffected by extreme weather conditions.

DETAILED DESCRIPTION OF THE DRAWINGS

DESCRIPTION OF THE PREFERRED EMBODIMENTS

The present invention relates to the field of outdoor support structures for signs, and more importantly, to a durable, weatherproof sign post assemblies. A first embodiment of the present invention is illustrated in FIGS. 1–5.

Figure 1:
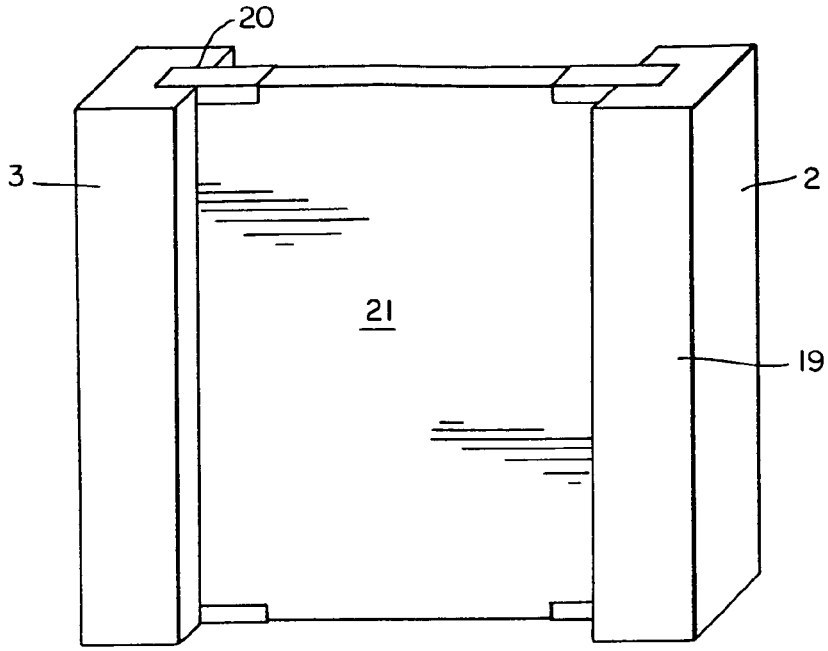
FIG. 1 is a plain view of a laminated sign post of the present invention.

A sign post assembly 2 is illustrated in FIG. 1. the sign post assembly 1 includes two or more sign posts 2, 3 however, only two sign posts are illustrated in FIG. 1. Each sign post 2, 3 is identical so only one will be described in detail.

Sign post 2 is made of a plurality of laminated sheets of high density polyethylene 11–18. In the preferred embodiment, each sheet is made of a high molecular weight polyethylene (HMWPE) or a high density polyethylene (HDPE). The polyethylene preferably is an ultra-high molecular weight polyethylene having a viscosity-based molecular weight (M.sub.0) of from approximately 250,000 to 2,000,000. The polyethylene is a high molecular weight polyethylene (HMWPE) a 5100 series high molecular weight polyethylene from General Electric, HMWPE 5100. Other polyethylenes are also available such as PAXON BA5O-100 from Allied and MARLEX HXM 50100 from Phillips.

In the preferred embodiment, limited additives and adjuvants are typically included in the plastic formulation used to make the panels. The hydrophobic ingredients tend to impart a degree of intrinsic lubricity to the surface of the panels. Other alternative hydrophobic ingredients conventional to extruded plastics can also be used. A thermal stabilizer is also added for outdoor stability. Stabilizers available on the market are WESTON 618-HT (from Borg-Warner), WESTON HPM-12, and TLPE.

Figure 2:
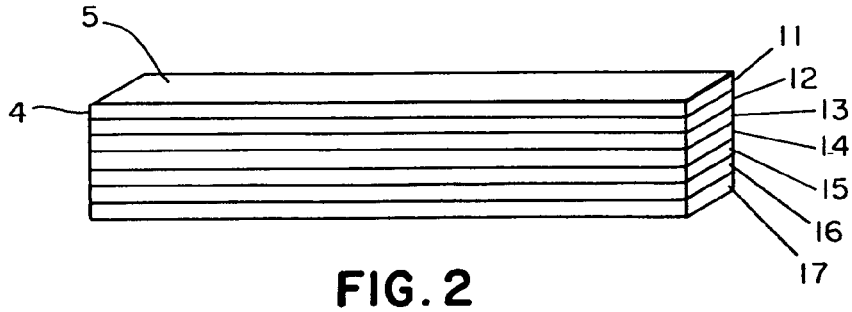
FIG. 2 is a plan view of a laminated sign post of the present invention.
Figure 3:
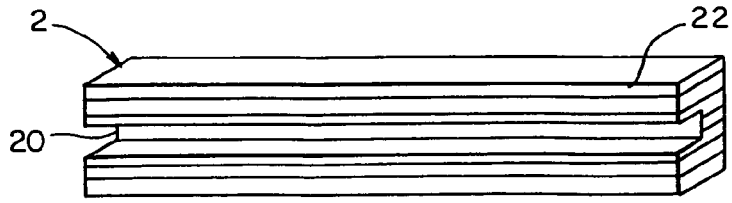
FIG. 3 is a plain view of a laminated sign post of the present invention.
Figure 4:
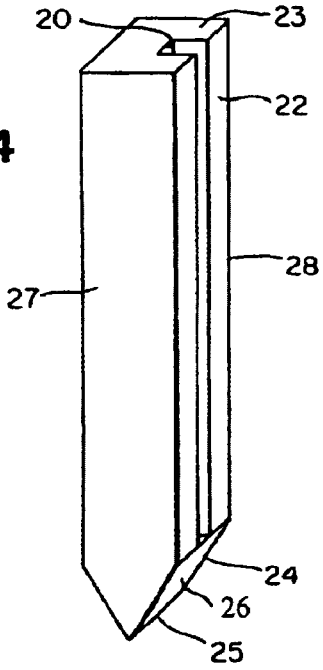
FIG. 4 is a plain view of a laminated sign post of the present invention.
Figure 5:
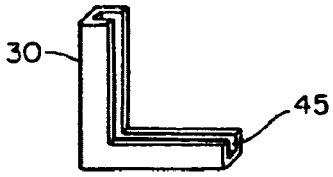
FIG. 5 is a plain view of a bracket.
Figure 6:
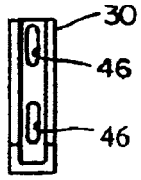
FIG. 6 is a plain view of a laminated sign post of the present invention.
Figure 7:
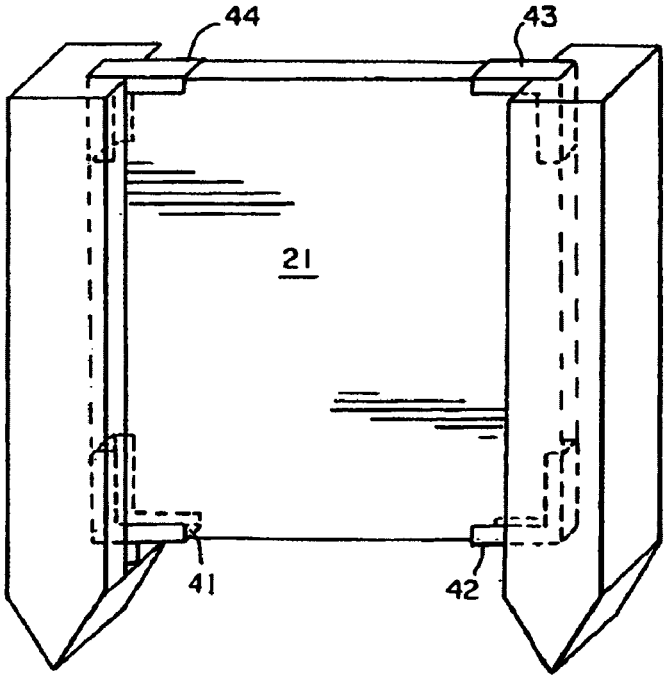
FIG. 7 is a plain view of a laminated sign post of the present invention.

Each sheet 11–18 has a thickness of less than 2 inches and is preferably less than one half inches thick. The sheets have polished side surfaces 19 to assist in the lamination process. Each post 2, 3 is formed by extruding five or more sheets 4 of high density polyethylene. The sheets are then laminated to form a large block 5 of the laminated sheets. The block 5 is then cut to form posts 2 as illustrated in FIG. 2 and in FIG. 3. Each sign post 2 has length substantially greater than the width and each sign post has a height of greater than three feet and less than seven feet.

The sign post 2 is then cut to form a sign receiving slot 20 for supporting a sign 21. The slot 20 is formed on an interior side wall 22 of the post 2. The slot generally has a depth of anywhere from 2–4 inches and a width slightly larger than the thickness of the sign board. The slot 20 extends from top wall 23 to substantially bottom area 24 where the slot terminates in a bottom end 25. The bottom end 25 may have a tapering portion 26 which forms a point for assisting the user for insertion into a supporting surface. The sign post 2 further includes an exterior side wall 26, a front wall 28. The a high molecular weight high density polyethylene provides a durable, weather resistant, sign post 2 for supporting signs year round all types of conditions. The laminated polyethylene posts provide an unexpected resistance to weather and offer a surface which is unaffected by extreme weather conditions.

In order to support the sign 21 between the posts 2, 3, an adjustable bracket means 30 is attached inside each sign receiving slot 20 for mounting supporting 21 sign between said sign posts 2, 3. The adjustable bracket means 40 includes four L-shaped brackets 41–44. The brackets 41–44 are made from plastic or metal but preferably aluminum. Each bracket has a channel 45 for receiving and supporting a corner of the sign 21. Elongated apertures 46 are formed in each channel for receiving a screw 4 to attach the bracket to the sign post 2. The bracket means 30 is adjustable along the slot 20 so that signs of different sizes may be mounted in the slot. The elongated slot 46 permits a quick adjustment of the L-shaped bracket to level the sign. L-shaped brackets 43 and 44 may be optionally used to lock the sign 21 between the sign posts. Preferably the sign or sign board is made of the same materials as the sign posts.

The invention claimed is:

1. A laminated sign post assembly for mounting a laminated polyethylene sign, said sign post assembly comprising;

at least two sign posts, each sign post is made of a plurality of laminated sheets of a high molecular weight high density polyethylene sheets, each sheet having a thickness of less than 2 inches, said sign posts having length substantially greater than the width, each sign post having a height of greater than three feet and less than seven feet, each said sign post having a tapering bottom end for insertion into a supporting surface, an interior side wall, an exterior side wall, a front wall, a rear wall and a top wall, said interior side wall having a sign receiving slot for supporting a sign, and, adjustable bracket means attached inside each sign receiving slot for mounting supporting said sign between said sign posts, said bracket means including at least two brackets, said bracket means made of aluminum, said brackets having channels for supporting said sign, each sign post having a width of less than 10 inches, said brackets each having an L-shape, wherein said sign is supported by at least four brackets.

2. An assembly for mounting a laminated polyethylene sign, said sign post assembly, said sign post assembly comprising; at least two or more sign posts, each sign post is made of a plurality of laminated sheets of a high molecular weight high density polyethylene, each sheet having a thickness of less than 2 inches, said sign posts having length substantially greater than the width, each sign post having a height of greater than three feet and less than seven feet, each said sign post having a tapering bottom end for insertion into a supporting surface, an interior side wall, an exterior side wall, a front wall, a rear wall and a top wall, said interior side wall having a sign receiving slot for supporting a sign, and; adjustable bracket means attached inside each sign receiving slot for mounting supporting said sign between said sign posts, said bracket means including at least two brackets, said bracket means made of aluminum, said brackets having channels for supporting said sign, each sign post having a width of less than 10 inches, said brackets each having an L-shape, wherein said sign is supported by at least four brackets.

3. The laminated sign post assembly as recited in claim 2, said bracket means including at least two brackets, said bracket means made of aluminum, said brackets having channels for supporting said sign, each sign post having a width of less than 10 inches, said brackets having an L-shape, said bracket means having at least four brackets for supporting said sign.

4. A laminated sign post assembly for mounting a laminated polyethylene sign, said sign post assembly, said sign post assembly comprising; at least two or more sign posts, each sign post is made of a plurality of laminated sheets of a high molecular weight high density polyethylene, each sheet having a thickness of less than 2 inches, said sign posts having length substantially greater than the width, each sign post having a height of greater than three feet and less than seven feet, each said sign post having a tapering bottom end for insertion into a supporting surface, an interior side wall, an exterior side wall, a front wall, a rear wall and a top wall, said interior side wall having a sign receiving slot for supporting a sign, and; adjustable bracket means attached inside each sign receiving slot for mounting supporting said sign between said sign posts, said bracket means including at least two brackets, said bracket means made of aluminum, said brackets having channels for supporting said sign, each sign post having a width of less than 10 inches, said brackets having an L-shape, said brackets each having an L-shape, wherein said sign is supported by at least four brackets.

* * * * *